US008397790B2

(12) United States Patent
Bariaud et al.

(10) Patent No.: US 8,397,790 B2
(45) Date of Patent: Mar. 19, 2013

(54) METHOD OF LOST-WAX MANUFACTURE OF AN ANNULAR BLADED TURBOMACHINE ASSEMBLY, METAL MOULD AND WAX MODEL FOR IMPLEMENTING SUCH A METHOD

(75) Inventors: Christian Bariaud, Orsay (FR); Yannick Collin, Saint Maur des Fosses (FR); Eric Herzer, Houilles (FR); David Mathieu, Chelles (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 13/498,713

(22) PCT Filed: Sep. 30, 2010

(86) PCT No.: PCT/EP2010/064573

§ 371 (c)(1),
(2), (4) Date: Mar. 28, 2010

(87) PCT Pub. No.: WO2011/039315

PCT Pub. Date: Apr. 7, 2011

(65) Prior Publication Data

US 2012/0180972 A1 Jul. 19, 2012

(30) Foreign Application Priority Data

Oct. 1, 2009 (FR) ..... 09 56850

(51) Int. Cl.
*B22C 9/10* (2006.01)
*B22C 7/02* (2006.01)
*B22C 21/14* (2006.01)

(52) U.S. Cl. ..... 164/45; 164/340; 164/397; 164/516; 164/517

(58) Field of Classification Search ..... 164/45, 164/122–122.2, 516–529, 361, 340, 397
See application file for complete search history.

(56) References Cited

U.S. PATENT DOCUMENTS 2,510,735 A 4/1946 Bodger
3,751,180 A 8/1973 Cameron
4,066,116 A * 1/1978 Blazek et al. ..... 164/17

(Continued)

FOREIGN PATENT DOCUMENTS

FR 1.188.819 9/1959

OTHER PUBLICATIONS

International Search Report and Written Opinion issued Nov. 18, 2010 in PCT/EP2010/064573 Filed Sep. 30, 2010 with English translation.
French Preliminary Search Report issued Aug. 11, 2010, in French Patent Application No. FR 0956850 with English Translation of Category of Cited Documents.

(Continued)

*Primary Examiner* — Kevin P Kerns
*Assistant Examiner* — Kevin E Yoon
(74) *Attorney, Agent, or Firm* — Oblon, Spivak, McClelland, Maier & Neustadt, L.L.P.

(57) ABSTRACT

A method of manufacture of a wax model of an annular bladed turbomachine stator assembly includes in succession the positioning, in a mold, of a core intended to form the impression of a cavity of a blade of the assembly, the injection of a wax in the mold, and the removal of the wax model fitted with the core from the mold. The core is manufactured in metal and is positioned such that its radially internal end is housed in the portion of the mold defining the blade including the cavity, away from the radially internal end of this portion of the mold.

7 Claims, 5 Drawing Sheets

U.S. PATENT DOCUMENTS 4,728,258 A 3/1988 Blazek et al.
6,119,761 A * 9/2000 Anazawa et al. ..... 164/35
7,296,615 B2 * 11/2007 Devine et al. ..... 164/516
2009/0229780 A1 * 9/2009 Skelley et al. ..... 164/24

* cited by examiner

METHOD OF LOST-WAX MANUFACTURE OF AN ANNULAR BLADED TURBOMACHINE ASSEMBLY, METAL MOULD AND WAX MODEL FOR IMPLEMENTING SUCH A METHOD

TECHNICAL FIELD

The present invention concerns the manufacture of an annular bladed stator assembly for a turbomachine, such as an aircraft turbomachine.

FIG. 1 represents such a bladed assembly 10, sometimes called an upstream or downstream guide vanes assembly, depending on its function within the turbomachine. This bladed assembly 10 typically includes two coaxial annular structures or shrouds, which are respectively internal 12 and external 14, and which are connected to one another by multiple blades 16.

The invention concerns more specifically the manufacture of a bladed assembly including at least one blade 18 incorporating a cavity, of generally lengthened shape in the radial direction intended, for example, for measuring physical parameters, such as the pressure and temperature of the air flowing along the blade, possibly via apertures 20 of this blade.

STATE OF THE PRIOR ART

Turbomachines' bladed stator assemblies are generally manufactured by a casting method of the "lost-wax" type, in which a wax model having the shape of the bladed assembly to be manufactured is produced beforehand, subsequently enabling manufacture of a cement mould by duplicate moulding of this wax model. After the wax is eliminated a metal alloy is cast in the cement mould obtained beforehand to form, after cooling and removal from the mould, the desired bladed assembly.

The wax model is manufactured previously by means of a metal mould having roughly the shape of the bladed assembly to be manufactured.

In the case of a bladed assembly at least one blade of which includes a cavity, a core of lengthened shape, as illustrated in FIG. 2, is inserted in the portion of the metal mould which defines the abovementioned blade to form the impression of the cavity. This core 22 is manufactured in a ceramic material, such that it has sufficient thermal resistance to tolerate the high temperatures inherent to the casting of the abovementioned metal alloy, and to allow subsequent elimination of this core by a conventional chemical method.

Wax is then injected under pressure into the metal mould fitted with the core so as to form, as it cools, a model of the bladed assembly to be manufactured, in which the core is encapsulated by wax and occupies the space corresponding to the abovementioned cavity.

During the injection of the wax the core is assembled on the metal mould such that it is held firmly in position, in order to limit optimally the risk of a deformation of the core under the pressure of the wax, which would impair the accuracy of the shape of the wax model, and consequently of the bladed assembly obtained at the end of the manufacturing method. The core is generally held in place by two tenons 24 and 26 (FIG. 2) formed respectively at both ends of the core, and protruding out of the metal mould, enabling them to be grasped by appropriate means of support.

The cement mould is then produced by duplicate moulding of the wax model previously obtained and fitted with the core, in a manner such that the cement encapsulates both tenons of this core which protrude outside the wax model. After this cement solidifies and after the wax is eliminated, a cement mould is then obtained fitted with the core, which is now held in place by the cement mould itself.

Next, after the metal alloy is cast into the previously obtained cement mould, and after this metal alloy has cooled, the core is eliminated, generally by a chemical method, and the metal piece obtained is removed from the mould to form an annular bladed assembly.

Eliminating the core leaves in the internal shroud of this bladed assembly an aperture 28 formed by the passage of one of the tenons of the core, as is shown in FIG. 3. Since the presence of an aperture in this location is not desirable, this aperture is generally plugged by brazing or a comparable method.

However, this plugging operation increases the cost of manufacture of the annular bladed assemblies.

In addition, the presence of brazed parts in the internal shrouds of these assemblies causes in these shrouds irregularities of shape and structure which are such that they reduce the mechanical resistance and therefore the lifetime of these shrouds.

In addition, the core can sometimes be deformed under the pressure of the wax when the latter is injected, leading to expensive disposals.

DESCRIPTION OF THE INVENTION

One aim of the invention is notably to provide a simple, economic and efficient solution to these problems.

To this end it offers a method of manufacture of a wax model of an annular bladed turbomachine stator assembly, intended for manufacture of a mould of this bladed assembly, where the model includes two coaxial shrouds, respectively radially internal and radially external, which shrouds are connected to one another by multiple blades, at least one of which includes an internal cavity, where the said method includes, in succession, using a metal mould having roughly a shape to be given to the said model of an annular bladed assembly:

positioning of a core, intended to form the impression of the said cavity, in a portion of the said metal mould which defines the blade including the cavity, where the abovementioned core has a generally lengthened shape having a radially external end assembled on the metal mould;

injection of a wax in the metal mould fitted with the abovementioned core;

after the wax has cooled, removal of the resulting wax model, fitted with the core, from the mould. According to the invention, the abovementioned core is manufactured in metal, and is positioned such that its radially internal end is housed in the portion of the mould defining the blade including the said cavity, away from the radially internal end of this portion of the mould.

Use of a metal core, which is more rigid than a ceramic core of the type habitually used, makes it possible to assemble this core on the metal mould only by its radially external end, whilst minimising the risks that this core will be deformed during injection of the wax. Such an assembly of the core on the metal mould is particularly advantageous when the wax model manufactured by means of this method is used in a method of manufacture of an annular bladed assembly, as will be shown more clearly in what follows.

The improved rigidity of the core means that it is possible to increase the injection pressure of the wax, and to reduce the rate of wax models which are defective as a consequence of a deformation of the core.

The invention also concerns a method of manufacture of an annular bladed turbomachine stator assembly including two coaxial shrouds, which are respectively radially internal and radially external, connected to one another by multiple blades at least one of which includes an internal cavity, where the said method includes, in succession:

manufacture of a wax model of the annular bladed assembly, by a method of the type described above;

manufacture of a mould in a refractory material by duplicate moulding of the abovementioned wax model, followed by elimination of the wax;

casting of a molten metal alloy in the mould made of refractory material fitted with the above-mentioned core to form the said annular bladed assembly;

after cooling of the metal alloy, removal of the annular bladed assembly from the mould, and elimination of the core.

This method of manufacture of an annular bladed assembly thus uses the method of manufacture of a wax model described above, in which the core is assembled on the metal mould only by its radially external end.

On conclusion of the steps of duplicate moulding of the wax model and of elimination of the wax, the radially external end of the core is encapsulated in the solidified refractory material and therefore enables the core to be connected to the mould manufactured in this material, whilst the radially internal end of the core extends inside this mould, away from the radially internal end of the portion of this mould defining the blade including the abovementioned cavity, and therefore away from the radially internal shroud of the mould.

As a consequence, the radially internal end of the core does not form an aperture in the internal shroud of the annular bladed assembly obtained by this method. It is, therefore, no longer necessary to accomplish an aperture plugging operation in this internal shroud, which allows the cost of manufacture of the annular bladed turbomachine stator assemblies to be reduced, and the lifetimes of these assemblies to be improved.

Preferentially, before producing the mould in a refractory material, the method of manufacture of an annular bladed turbomachine stator assembly also includes the extraction of the said metal core out of the said wax model, followed by the positioning in the impression formed in the wax by the said metal core of a core of the same shape manufactured in a ceramic material.

The core produced in a ceramic material has improved thermal resistance, and is therefore more suitable for the subsequent step of casting of the molten metal alloy. In addition, the ceramic core can be eliminated, at the end of the method, by a conventional chemical method.

The metal core preferentially has a section which tapers in the direction of its radially internal end.

The tapering shape of the metal core enables its extraction from the wax model to be facilitated, whilst reducing the risks of damaging this model. The rigidity of this metal core also enables the risks of breakage of the core when it is extracted to be limited.

If the metal core is replaced by a ceramic core as described above, the latter has the same shape as that of the metal core, and the tapering character of this shape facilitates the insertion of this ceramic core in the impression previously formed by the metal core.

However, the method according to the invention can be implemented without undertaking the abovementioned step of exchange of cores, notably when the metal constituting the metal core has a sufficiently high melting point compared to the melting point of the metal alloy cast in the mould made of refractory material, to enable the metal core to tolerate the casting of this alloy without any risk that the core may melt.

The invention also concerns a metal mould intended for manufacture, by a method of the type described above, of a wax model of an annular bladed turbomachine stator assembly including two coaxial shrouds, respectively radially internal and radially external, which shrouds are connected to one another by multiple blades, at least one of which includes an internal cavity, where the mould includes, in a portion which defines the said blade including the cavity, a core of a generally lengthened shape having a radially external end assembled on the metal mould to form the impression of the said cavity, characterised in that the core is manufactured in metal, and is positioned such that its radially internal end is housed in the said portion of the mould defining the blade including the said cavity, away from the radially internal end of the said portion of the mould.

The invention also concerns a wax model intended for manufacture, by a method of the type described above, of an annular bladed turbomachine stator assembly including two coaxial shrouds, respectively radially internal and radially external, which shrouds are connected to one another by multiple blades, at least one of which includes an internal cavity, where the mould includes, in a portion which defines the said blade including the cavity, a core of a generally lengthened shape having a radially external end protruding from the model, to form the impression of the said cavity, characterised in that the core is manufactured in metal, and is positioned such that its radially internal end is housed in the said portion of the model defining the blade including the said cavity, away from the radially internal end of the said portion of the model.

BRIEF DESCRIPTION OF THE ILLUSTRATIONS

The invention will be better understood, and other details, advantages and characteristics of it will appear, on reading the following description given as a non-restrictive example, and with reference to the appended illustrations, in which:

FIG. 1, previously described, is a perspective view of an annular bladed turbomachine stator assembly of a known type;

FIG. 2, previously described, is a perspective view of a core of a known type, intended for the manufacture of the bladed assembly of FIG. 1;

DETAILED DESCRIPTION OF PREFERRED EMBODIMENTS

Figure 1:
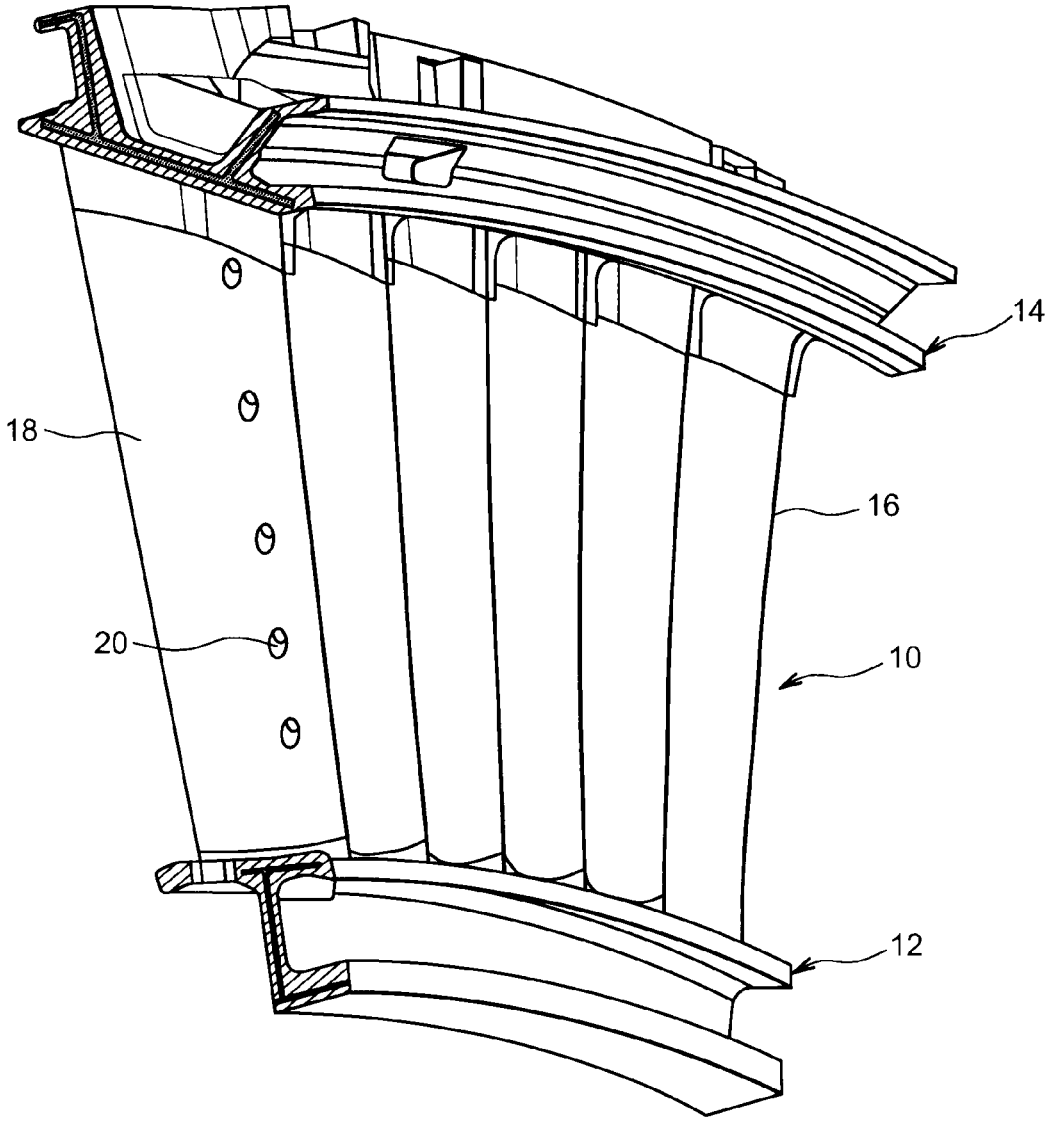
Figure 4:
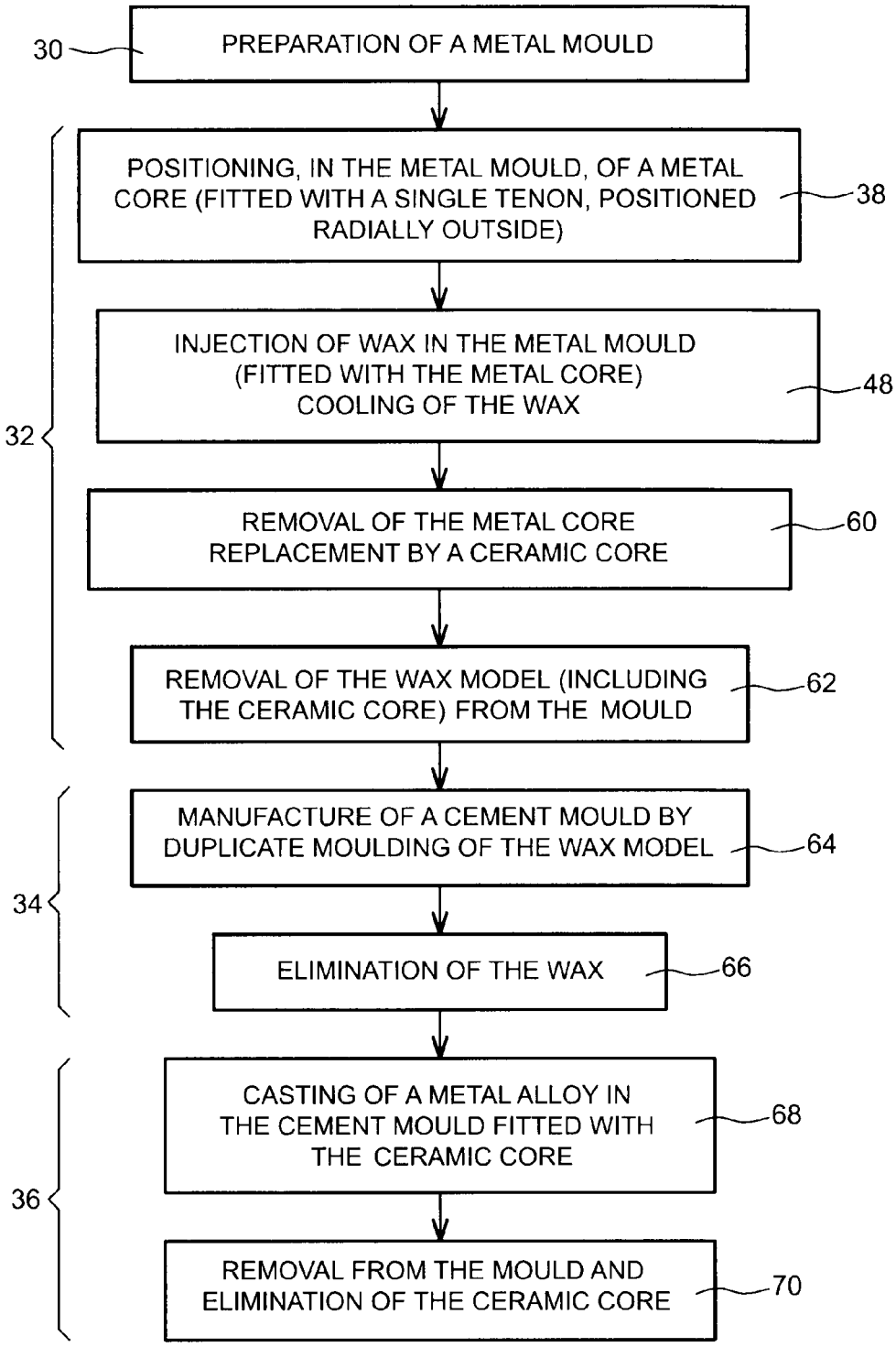
FIG. 4 is a flow chart illustrating the main steps of a method according to the invention to manufacture an annular bladed turbomachine stator assembly.

The flow chart of FIG. 4 illustrates a method in accordance with the invention for the manufacture of an annular bladed turbomachine stator assembly of the same type as the bladed assembly represented in FIG. 1, and therefore including two coaxial shrouds, respectively internal 12 and external 14, connected to one another by multiple blades 16, at least one blade of which 18 includes a cavity.

This method includes four successive main phases, designated by the respective references 30, 32, 34 and 36 in the flow chart of FIG. 4.

The first phase 30 consists of the preparation, in a conventional manner, of a metal mould of the bladed assembly to be manufactured; the second phase 32 consists of the manufacture of a wax model of the bladed assembly by means of this metal mould; the third phase 34 consists of the manufacture of a mould in cement, or more generally any appropriate refractory material, by duplicate moulding of the wax model; and the fourth phase 36 consists of the manufacture of the bladed assembly by means of the abovementioned cement mould.

Figure 2:
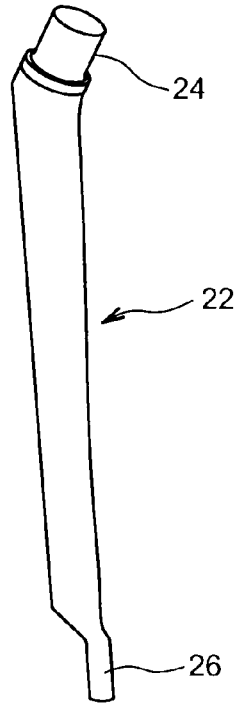
Figure 3:
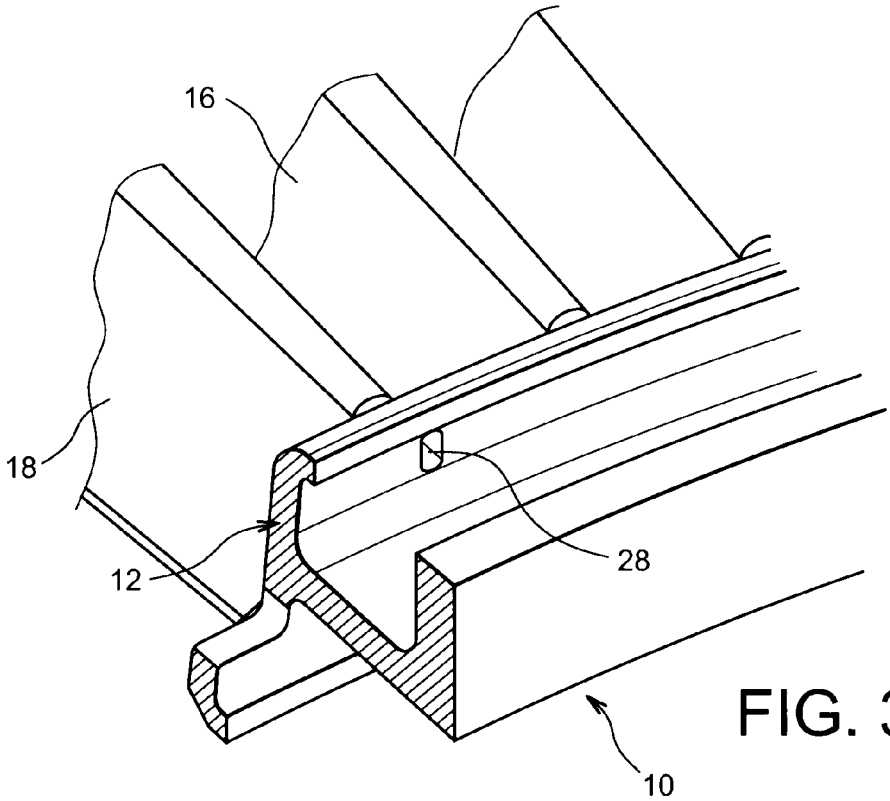
FIG. 3 is a partial schematic view of the internal shroud of the annular bladed assembly of FIG. 1, before its aperture formed by the core of FIG. 2 is plugged.

More specifically, second phase 32 includes a step 38 of positioning, in the metal mould, of a core which differs from the conventional core of FIG. 2 in that it is manufactured in a metal, for example a steel, and in that it has no tenon at its end intended to be positioned radially towards the interior in the mould.

Figure 5:
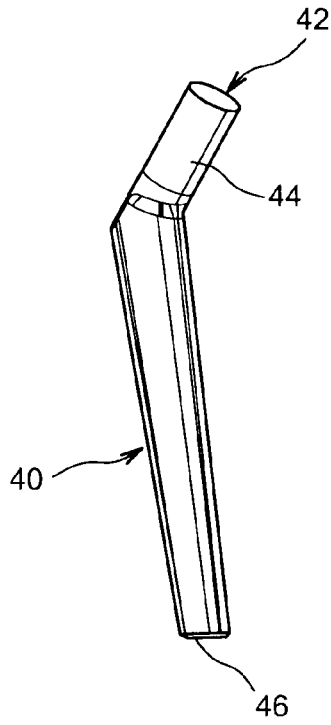
FIG. 5 is a perspective schematic view of a core intended for implementation of the method of FIG. 4.

FIG. 5 illustrates a core 40 of this type, and shows in particular its end 42, which is intended to be positioned radially towards the exterior in the mould, and which is provided with a tenon 44 comparable to tenon 24 of the core of FIG. 2 of the conventional type, and its end 46, which is intended to be positioned radially towards the interior in the mould, and which has no tenon. This core 40 has a transverse section which tapers in the direction of its abovementioned end 46, as is shown in FIG. 5, which is made possible notably by the absence of a tenon at this end.

In the abovementioned step 38 (FIG. 4), core 40 is installed in the portion of the metal mould defining the blade of the bladed assembly which includes a cavity, such that tenon 44 of end 42 of this core protrudes outside the mould passing through an aperture of the wall of this mould defining the radially external shroud of the bladed assembly, and such that the other end 46 of this core extends within the mould, away, radially towards the exterior, from the wall of this mould defining the radially internal shroud of the bladed assembly.

The next step 48 of second phase 32 of the method consists in injecting a wax under pressure into the metal mould fitted with metal core 40 described above, in a conventional manner, until the mould is filled with wax, and where the core is then encapsulated in the wax, except for its tenon which protrudes outside the metal mould. The rigidity of the metal core prevents the latter from being deformed during the injection of the wax, despite the pressure exerted on the core by this wax.

Figure 6:
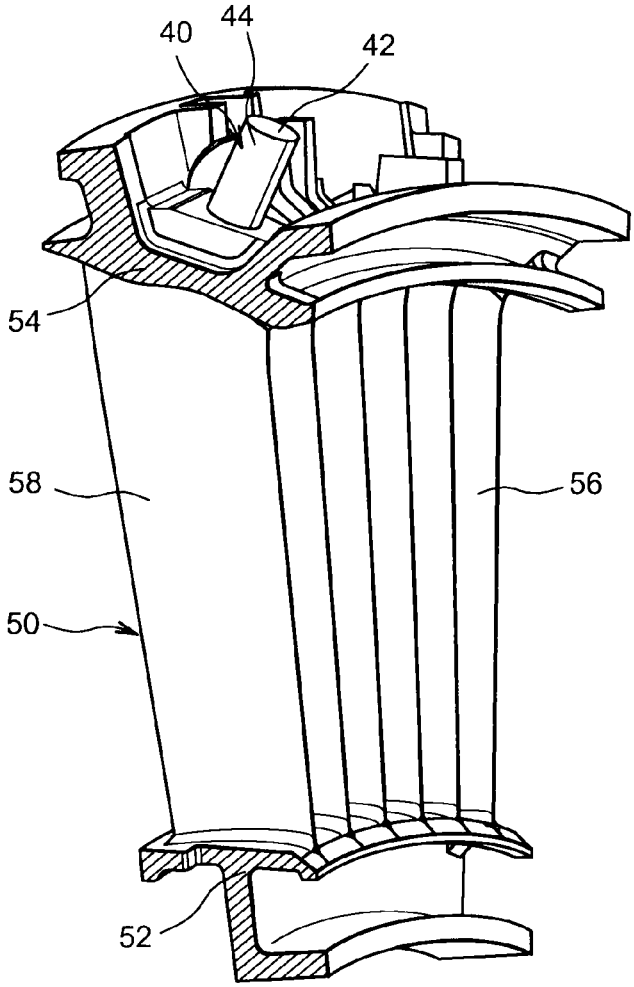
FIG. 6 is a partial perspective schematic view of a wax model of an annular bladed assembly, in which the core of FIG. 5 is installed.
Figure 7:
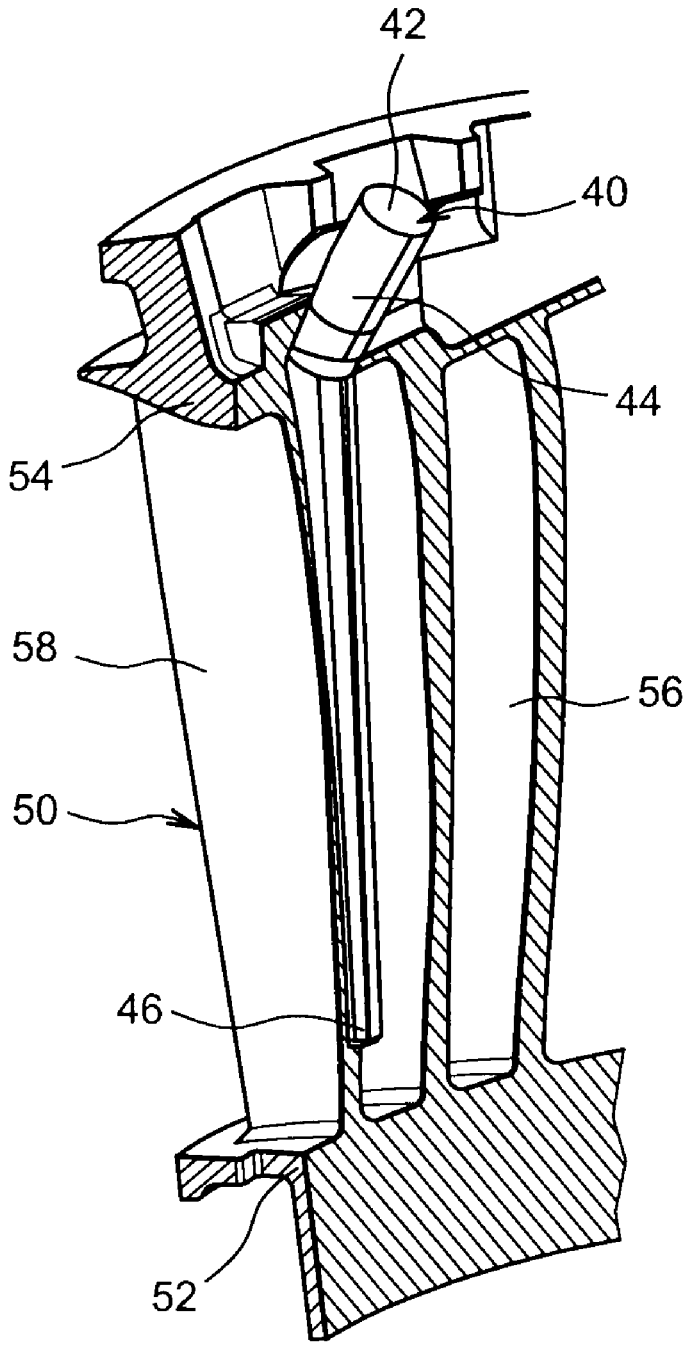
FIG. 7 is a view similar to FIG. 6, with a transverse cross-section.

After cooling the hardened wax forms a model 50 of the annular bladed assembly to be manufactured, as illustrated by FIGS. 6 and 7. This model 50 has roughly the shape of the annular bladed assembly, and therefore includes two coaxial shrouds, respectively internal 52 and external 54, and multiple blades 56 connecting these two shrouds and including a blade 58 intended to define the blade of the bladed assembly which incorporates a cavity, where this blade 58 of the wax model is the one which incorporates core 40. FIG. 7 illustrates in particular the position of radially internal end 46 of core 40, which is positioned away, radially towards the exterior, from radially internal shroud 52 which forms the radially internal end of blade 58.

In the preferred implementation of the method according to the invention, second phase 32 of this method is continued by a step 60 consisting in removing metal core 40 from the wax model, and in replacing it by a core of the same shape manufactured in a ceramic material, and consequently having improved thermal resistance. Metal core 40 is removed by moving this core in a roughly rectilinear translational movement radially towards the exterior of the model. The tapering shape, radially towards the interior, of metal core 40, enables the risks of damage of the wax during this extraction operation to be reduced optimally. The intended purpose of the replacement of metal core 40 by the ceramic core is to enable the core better to tolerate the subsequent casting of a molten metal alloy, and to facilitate elimination of this core by a conventional chemical method at the end of the manufacturing method, as will be shown more clearly in what follows.

Second phase 32 of the method is completed by a step 62 of removal of wax model 50 incorporating the ceramic core from the mould.

The method then continues by third phase 34, which includes a step 64 of manufacture of a mould in cement, or a comparable material, by duplicate moulding of wax model 50 which was previously obtained. More specifically, this wax model 50 is coated with cement such that the cement encapsulates the tenon of the ceramic core incorporated in this model.

Third phase 34 is concluded by a step 66 of elimination of the wax, in a conventional manner including, for example, heating of this wax, in order to obtain a cement mould fitted with the above-mentioned ceramic core, the tenon of which is sunk in the mould in such a manner as to hold this core in rigid fashion.

Fourth phase 36 of the method includes a step 68 of casting of a molten metal alloy in the previously obtained cement mould. The core fitted to the mould enables the corresponding cavity of blade 18 of the annular bladed assembly to be formed. The next step 70 consists, after cooling of the metal alloy in the mould, of removal from the mould of the bladed assembly obtained in this manner, and of elimination of the ceramic core, by a conventional method, preferably of the chemical type.

Since the core's radially internal end has not protruded outside the bladed assembly in the course of the method described above, the internal shroud of this assembly does not include any aperture formed by the core, after the latter has been eliminated. The method according to the invention thus enables a final step of plugging of the internal shroud of the annular bladed assemblies to be spared, and enables the regularity of shape and structure of this shroud to be improved.

The method according to the invention can, as a variant, be implemented without performing step 60 of removal of the metal core, and of replacement of this core by a ceramic core. In this case, the entire method is accomplished by means of this same metal core. The metal core then has a sufficiently high melting point relative to that of the cast metal alloy in order to tolerate the high temperatures inherent to the casting of the molten metal alloy during step 68.

The method according to the invention can generally be used for the manufacture of annular bladed assemblies forming a single piece, such as the assembly described above, or for the manufacture of assemblies formed from multiple sectors assembled end-to-end circumferentially, in which case each of the sectors comprising a blade having an internal cavity can be produced by means of this method.

The invention claimed is:

1. A method of manufacture of a wax model of an annular bladed turbomachine stator assembly for manufacture of a mould of this bladed assembly, the model including two coaxial shrouds, respectively radially internal and radially external, which shrouds are connected to one another by multiple blades, at least one of which includes an internal cavity, the method comprising:

using a metal mould having roughly a shape to be given to the model of an annular bladed assembly;

positioning of a core, intended to form an impression of the cavity, in a portion of the metal mould which defines the blade including the cavity, the core including a generally lengthened shape with a radially external end assembled on the metal mould;

injecting a wax in the metal mould fitted with the core; and after the wax has cooled, removing the resulting wax model, fitted with the core, from the mould, wherein the core is manufactured in metal, and is positioned such that its radially internal end is housed in the portion of the mould defining the blade including the cavity, not contacting the radially internal shroud portion of the mould.

2. The method according to claim 1, wherein the metal core has a transverse section which tapers in the direction of its radially internal end.

3. A method of manufacture of an annular bladed turbomachine stator assembly including two coaxial shrouds, which are respectively radially internal and radially external, connected to one another by multiple blades at least one of which includes an internal cavity, the method comprising:

manufacturing a wax model of the bladed annular assembly, by the method according to claim 1;

manufacturing a mould in a refractory material by duplicate moulding of the wax model, followed by elimination of the wax;

casting a molten metal alloy in the mould made from a refractory material fitted with the core to form the bladed annular assembly;

after the metal alloy has cooled, removing the bladed annular assembly and eliminating the core.

4. The method according to claim 3, further comprising:

before the manufacturing the mould in the refractory material, extracting the metal core out of the wax model, followed by positioning in the impression formed in the wax by the metal core of a core of the same shape manufactured in a ceramic material.

5. The method according to claim 4, wherein the refractory material is a cement.

6. A metal mould for manufacture, by a method according to claim 1, of a wax model of an annular bladed turbomachine stator assembly including two coaxial shrouds, respectively radially internal and radially external, the shrouds being connected to one another by multiple blades, at least one of which includes an internal cavity, the mould comprising:

a core of a generally lengthened shape having a radially external end assembled on the metal mould to form an impression of the cavity, wherein the core is manufactured in metal, and is positioned such that its radially internal end is housed in a portion of the mould defining the blade including the cavity, not contacting a radially internal shroud portion of the mould.

7. A wax model for manufacture, by a method according to claim 3, of an annular bladed turbomachine stator assembly including two coaxial shrouds, respectively radially internal and radially external, the shrouds being connected to one another by multiple blades, at least one of which includes an internal cavity, the model comprising:

a core of a generally lengthened shape having a radially external end protruding from the model, to form an impression of the cavity, wherein the core is manufactured in metal, and is positioned such that its radially internal end is housed in a portion of the model defining the blade including the cavity, not contacting a radially internal shroud portion of the model.

* * * * *

UNITED STATES PATENT AND TRADEMARK OFFICE

CERTIFICATE OF CORRECTION

PATENT NO. : 8,397,790 B2
APPLICATION NO. : 13/498713
DATED : March 19, 2013
INVENTOR(S) : Christian Bariaud et al.

It is certified that error appears in the above-identified patent and that said Letters Patent is hereby corrected as shown below:

Title Page, Item (86), § 371(c)(1), (2), (4) Date, change "Mar. 28, 2010" to --Mar. 28, 2012--.

Signed and Sealed this
Eighteenth Day of June, 2013

Teresa Stanek Rea
*Acting Director of the United States Patent and Trademark Office*